US010286545B2

(12) United States Patent
Barraud

(10) Patent No.: US 10,286,545 B2
(45) Date of Patent: May 14, 2019

(54) PORTABLE APPLIANCE FOR MARKING A SURFACE

(71) Applicant: SIC MARKING GROUP, Pommiers (FR)

(72) Inventor: Gerard Barraud, Le Perreon (FR)

(73) Assignee: SIC MARKING GROUP, Pommiers (FR)

( * ) Notice: Subject to any disclaimer, the term of this patent is extended or adjusted under 35 U.S.C. 154(b) by 157 days.

(21) Appl. No.: 15/501,887

(22) PCT Filed: Jun. 24, 2015

(86) PCT No.: PCT/FR2015/051694

§ 371 (c)(1),
(2) Date: Feb. 6, 2017

(87) PCT Pub. No.: WO2016/020586

PCT Pub. Date: Feb. 11, 2016

(65) Prior Publication Data

US 2017/0232609 A1 Aug. 17, 2017

(30) Foreign Application Priority Data

Aug. 8, 2014 (FR) ..... 14 57727

(51) Int. Cl.

| | |
|---|---|
| ***B25H 7/04*** | (2006.01) |
| ***B44B 7/02*** | (2006.01) |
| ***B44B 3/02*** | (2006.01) |

(52) U.S. Cl.

CPC ..... *B25H 7/045* (2013.01); *B25H 7/04* (2013.01); *B44B 3/02* (2013.01)

(58) Field of Classification Search

CPC ..... B25H 7/04; B25H 7/045; B44B 3/009; B44B 3/02; B44B 5/0085

(Continued)

(56) References Cited

U.S. PATENT DOCUMENTS 4,211,012 A * 7/1980 Alles et al. ..... B41J 2/5056 118/211
4,808,018 A * 2/1989 Robertson et al. ... B44B 5/0061 101/3.1

(Continued)

FOREIGN PATENT DOCUMENTS

CA 2656895 C * 3/2011 ..... B26D 5/00
FR 2 256 833 8/1975

(Continued)

*Primary Examiner* — R. A. Smith
(74) *Attorney, Agent, or Firm* — Clark & Brody

(57) ABSTRACT

The invention relates to a portable appliance for marking a surface, the appliance comprising a housing (2) presenting a front face that is open for passing a marker member that is moved by a device for moving the marker member in a two-dimensional marking zone (Z). The housing is provided with a positioning nose (30) for positioning the appliance over the surface for marking, the positioning nose defining firstly the two-dimensional marking zone (Z) facing the front face of the housing and at a distance from the front face, and secondly an opening (35) extending the top wall for enabling the two-dimensional marking zone to be viewed, the top wall of the housing being fitted with a display screen in such a manner that the screen and the two-dimensional marking zone as seen through the opening of the positioning nose appear simultaneously in the field of view of an operator.

12 Claims, 5 Drawing Sheets

(58) Field of Classification Search
USPC ..... 33/32.1, 32.3
See application file for complete search history.

(56) References Cited

U.S. PATENT DOCUMENTS

| | | | | |
|---|---|---|---|---|
| 4,834,595 | A * | 5/1989 | Cacciott | B44B 3/009 409/80 |
| 7,021,847 | B2 * | 4/2006 | Lunn | B41J 2/22 400/124.01 |
| 8,037,815 | B2 * | 10/2011 | Galland et al. | B23Q 1/44 101/3.1 |
| 8,336,214 | B2 * | 12/2012 | Kawaguchi et al. | B44B 3/009 112/2 |
| 2007/0035777 | A1 * | 2/2007 | Kintner | B44B 3/009 358/3.29 |
| 2018/0050430 | A1 * | 2/2018 | Ashworth | B23Q 1/012 |

FOREIGN PATENT DOCUMENTS

| | | | | |
|---|---|---|---|---|
| FR | 2 871 402 | | 12/2006 | |
| FR | 2928288 | A1 * | 9/2009 | B23Q 1/0009 |

* cited by examiner

PORTABLE APPLIANCE FOR MARKING A SURFACE

FIELD OF THE INVENTION

The present invention relates to the technical field of portable appliances for marking the surface of an article in the broad sense, and the invention relates more particularly, but not exclusively, to devices that perform marking by deforming the surface of the article.

In the above preferred technical field, it is known

BACKGROUND OF THE INVENTION to mark metal objects, e.g. by micropercussion using a pin that is driven with reciprocating motion in translation and that strikes the surface for marking so as to form a substantially dot-shaped impact. That appliance also includes a device for moving the marker member so as to move it in two crossed directions in a two-dimensional marking zone or window.

In the state of the art, there are several variant proposals for making marker appliances. For example, patent FR 2 256 833 describes an appliance including a device for moving the marker member, both in translation and in turning about an axis parallel to the translation direction. That appliance has a grip handle making it portable and constituting a solution that provides great flexibility in use, while making it possible to adapt to parts that are difficult to access.

In the state of the art, marker appliances are also known having certain models that include a screen enabling the marking that is to be made to be displayed.

In practical use of such portable marker appliances, it is found that they are not ergonomic insofar as they are not adapted to the operator's conditions of use.

Specifically, those appliances are often bulky, and do not enable the two-dimensional marking zone of the appliance to be viewed. This leads to a lack of accuracy in the marking performed in that way. Furthermore, with portable appliances that do not include a display screen, the operator cannot verify easily, prior to the marking operation, that the marking that is going to be made corresponds to the marking that is desired. With a portable appliance having a display screen, the operator is often obliged to disengage the marker member from the surface in order to verify on the screen that the marking it is going to make corresponds to the desired marking. Furthermore, there is frequently difficulty in ensuring that the appliance is pressing correctly against the surface for marking, in particular because of the architecture of the housing. Finally, without having recourse to complex mechanisms, such marker appliances are not adapted to providing an option of adjusting the impact force as a function of the material constituting the surface that is to be marked.

SUMMARY OF THE INVENTION

The object of the invention seeks to remedy the drawbacks of the state of the art by proposing a novel portable appliance for marking a surface that is designed to facilitate marking operations and make them more reliable.

To achieve this object, the invention provides a portable appliance for marking a surface of an article, the appliance comprising:

- a housing provided with at least one handle and presenting remote from a rear face an open front face for passing a marker member that forms part of a marker system and that is adapted to make at least one substantially dot-shaped mark, the front and rear faces being connected together at least by a top wall and by two opposite side walls, at least one of the faces of the housing being provided with a display screen; and
- a movement device for moving the marker member that is mounted inside the housing and that is adapted to move the marker member over the surface for marking in a two-dimensional marking zone.

According to the invention, the housing is provided with a positioning nose for positioning the appliance against the surface for marking, the positioning nose defining firstly the two-dimensional marking zone in register with the front face of the housing and at a distance from the front face, and secondly an opening in line with the top wall for viewing the two-dimensional marking zone, and the top wall of the housing is fitted with the display screen in such a manner that the screen and the two-dimensional marking zone as seen through the opening of the positioning nose appear simultaneously in the field of view of an operator above the top wall of the housing.

In addition, the appliance of the invention may also present in combination at least one and/or more of the following additional characteristics:

- the top wall presents a profile that is curved towards the inside of the housing, extending from the display screen and as far as the front end edge defining a portion of the front face of the housing;
- the two-dimensional marking zone defined by the positioning nose is situated at a distance from the front end edge of the top wall, which distance lies in the range 50 millimeters (mm) to 80 mm, while the front edge of the display screen is situated at a distance from the two-dimensional marking zone that lies in the range 70 mm to 120 mm;
- the top wall includes a man-machine interface with the display screen situated as close as possible to the front end edge of the top panel;
- the positioning nose includes at least two arms extending substantially from the side walls of the housing and connected together by an open bearing plate for defining the two-dimensional marking zone;
- the housing includes at its rear face a rear thrust wall for the operator, which rear thrust wall is rigidly connected to the positioning nose;
- a unit for controlling the operation of the display screen and of the device for moving the marker member in such a manner as to display on the screen the marking that is to be made prior to and simultaneously with controlling the marker member;
- the housing includes a handle extending from a bottom wall situated in register with the top wall;
- at its end remote from its end connected to the housing, the handle is fitted with a support for interchangeably connecting an electrical power supply battery of the appliance;
- the power supply battery has a plane face for supporting the appliance in an upstanding position;
- the device for moving the marker member is mounted on a carriage that is slidably mounted for adjusting the position of the marker member relative to the two-dimensional marking zone, a mechanism for moving and locking the carriage relative to the housing being provided with a manual control; and
- the mechanism for moving the carriage includes an eccentric that is turned by a knob and that serves to move the carriage in translation, the carriage being guided to move in translation relative to the housing, the control knob of the eccentric being locked in position by a locking lever.

BRIEF DESCRIPTION OF THE DRAWINGS

Various other characteristics appear from the description made below with reference to the accompanying drawings, which show embodiments of the invention as non-limiting examples.

DETAILED DESCRIPTION OF THE INVENTION

Figure 1:
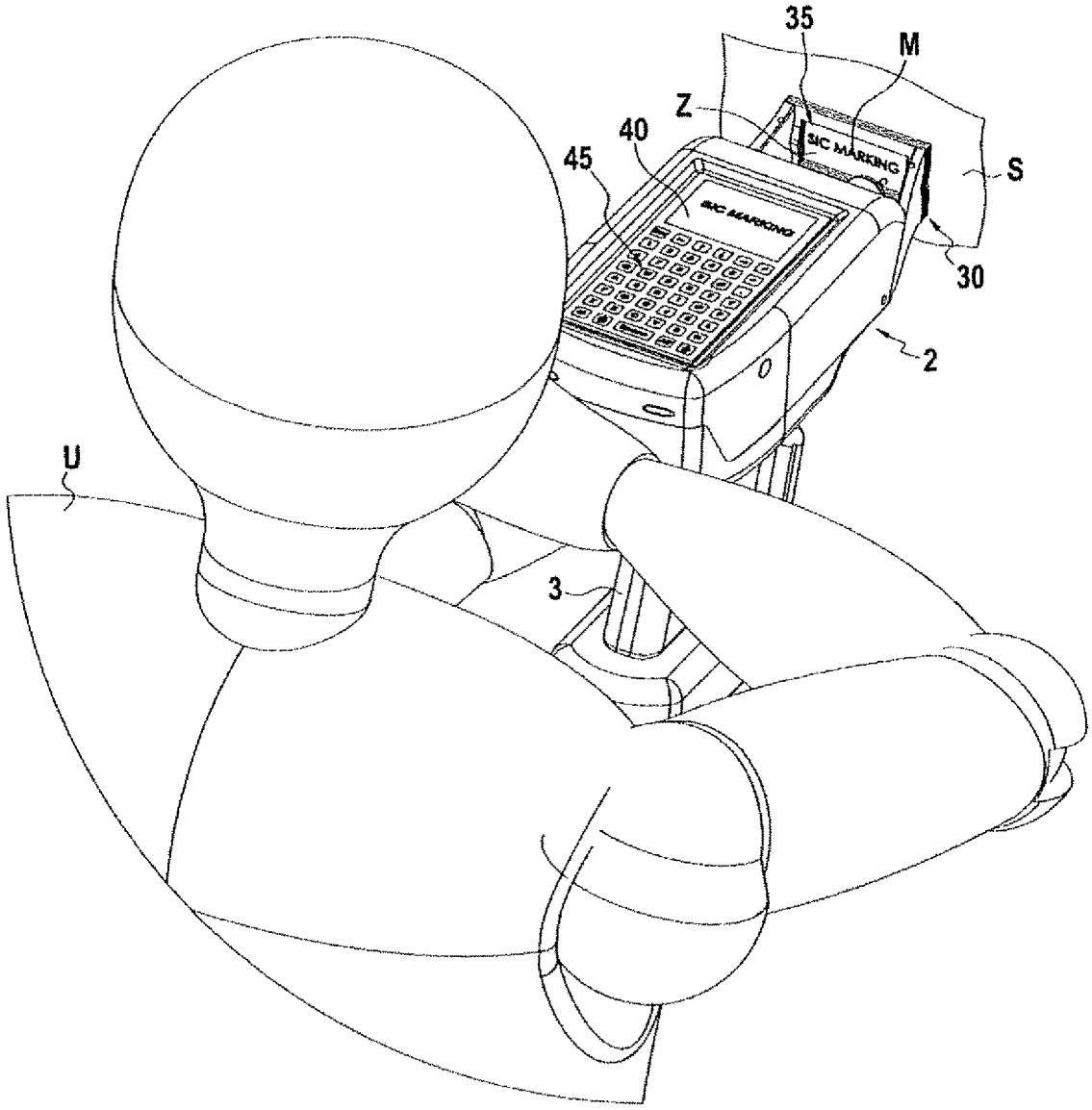
FIG. 1 is a perspective view of an embodiment of a portable marker appliance in accordance with the invention, while it is being used.
Figure 2:
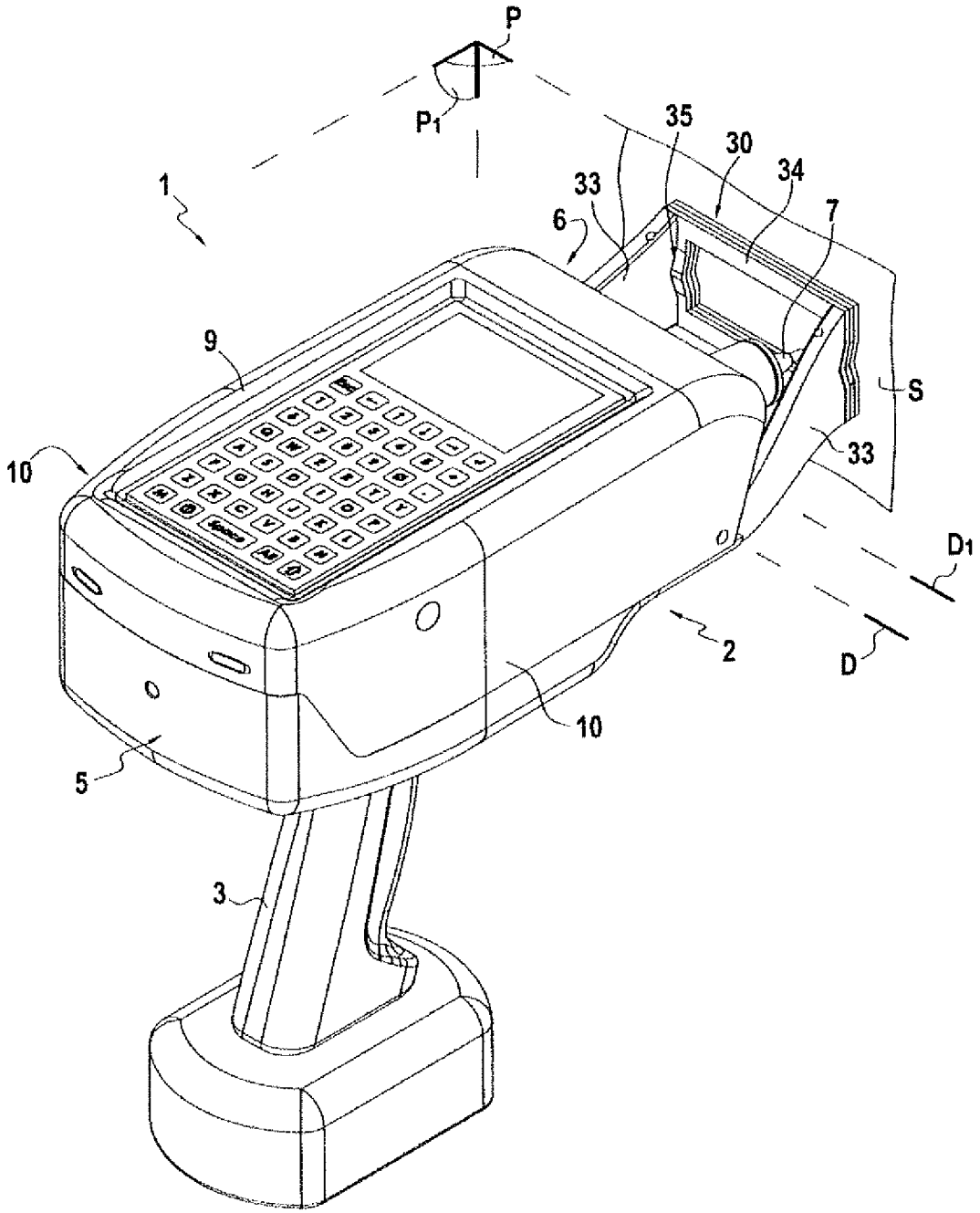
FIG. 2 is a perspective view of a portable marker appliance in accordance with the invention.
Figure 3:
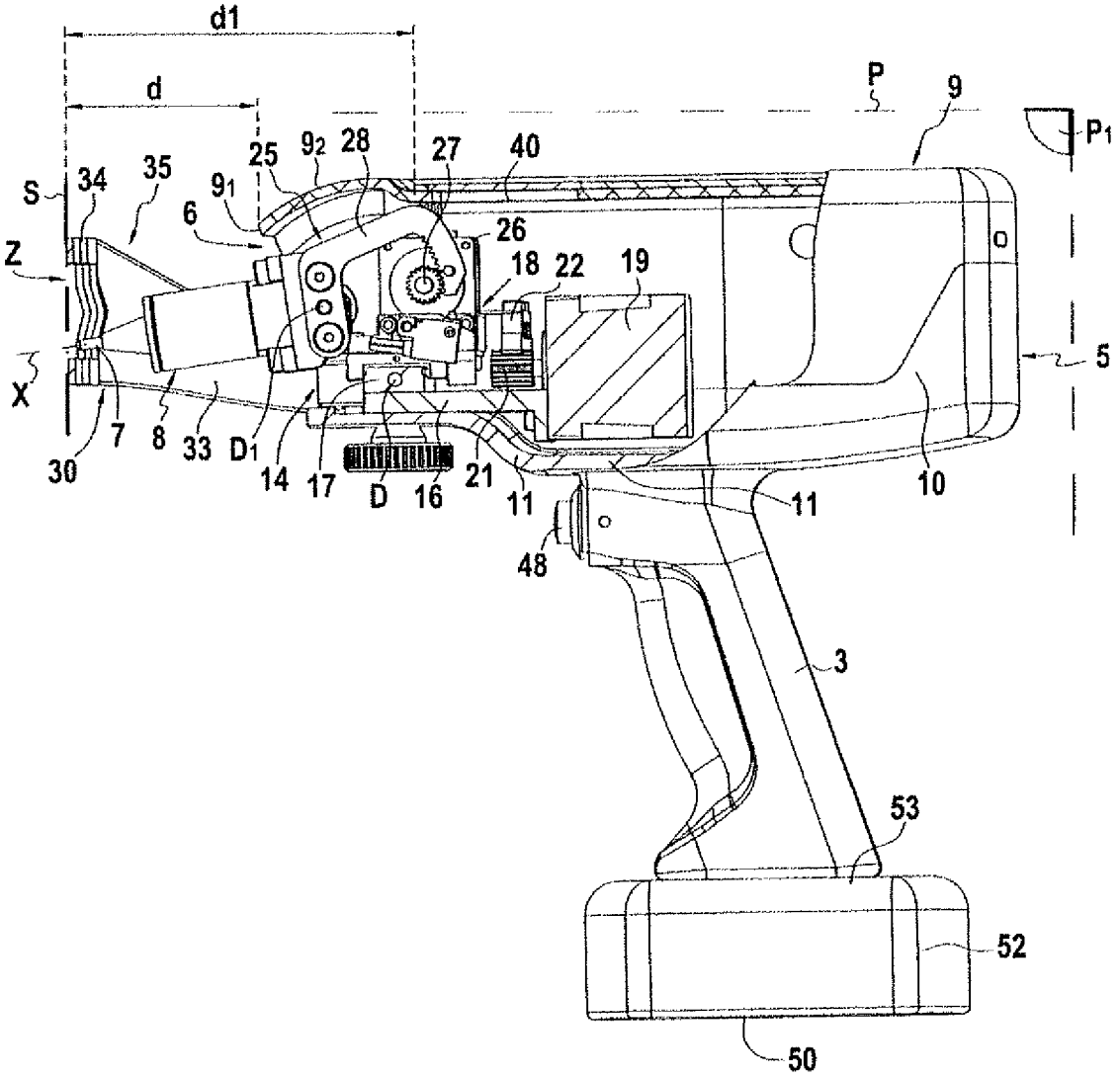
FIGS. 3 and 4 are fragmentary elevation views in section of the portable marker appliance in accordance with the invention showing the marker member positioned respectively in an advanced position and in a retracted position.
Figure 4:
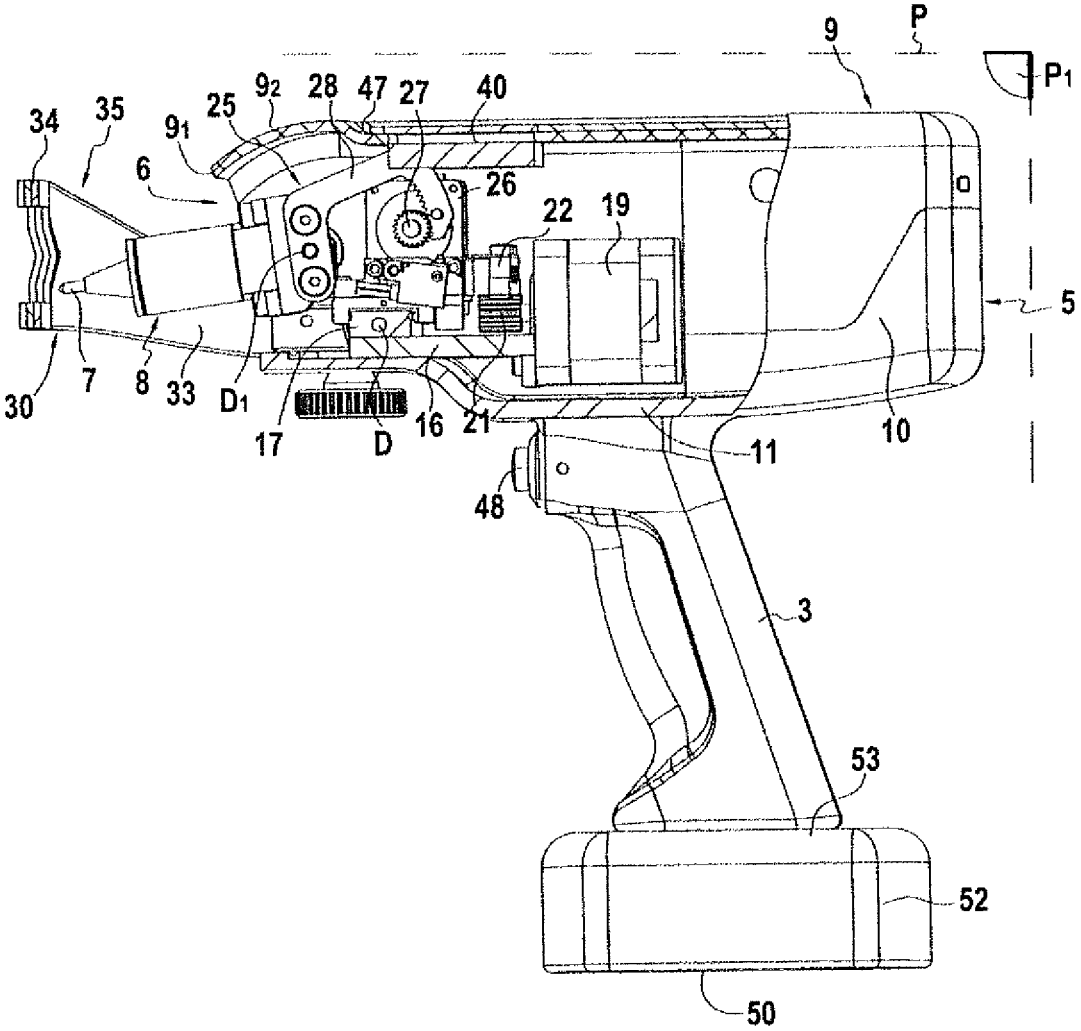

As can be seen more precisely in FIGS. 1 to 4, the invention provides a portable appliance 1 for providing marking M on a surface S of an article in the broad sense.

The appliance 1 of the invention comprises a housing 2 that is generally in the form of a rectangular parallelepiped and that is fitted with at least one handle, and in the example shown with only one handle 3. Opposite from a rear face 5, the housing 2 presents a front face 6 that is open in order to pass a marker member 7 that forms a portion of a marker system 8 of any known type and that is described in greater detail in the description below.

The housing 2 also has a connection body between the rear and front faces 5 and 6, formed at least by a top wall 9 extended on either side by two opposite side walls 10. In the example shown, the two side walls 10 are connected together by a bottom wall 11 that extends in register with and at a distance from the top wall 9.

As can be seen clearly in the figures, the housing 2 thus presents a rigid body of rectangular section formed by the top wall 9, the bottom wall 11, and the two side walls 10, which are connected together to form a rigid body. At its rear face 5, the housing 2 also has a rear wall that is securely mounted to the body of the housing and that forms a thrust or bearing surface for the operator, as explained in greater detail in the description below. It should be observed that, for reasons of clarity, the terms "top" and "bottom" are used with reference to the conditions of use of the appliance by an operator whose field of view is situated on the same side as the top wall 9. Naturally, the appliance could be used in any other sloping or vertical position such that the person skilled in the art can easily change the words used to specify the walls accordingly.

According to an advantageous embodiment characteristic, the height of the housing 2, which corresponds to the distance between the top and bottom walls 9 and 11, is such as to enable the housing to be grasped using the side walls 10 with the thumb of a hand pressing against the top wall 9 while the fingers of that hand support the housing via its bottom wall 11. Typically, the height of the housing 2 lies in the range 40 mm to 90 mm.

In the embodiment shown, the handle 3 projects from the bottom wall 11. Naturally, it is possible to envisage fitting the housing 2 with two handles that extend from opposite sides of the housing, from its side walls 10.

In a preferred embodiment, but not exclusively, the marker system 8 is an electromagnetic micropercussion system comprising, as its marker member 7, a marker pin having an end for impacting the surface S of an article in order to make a point of impact or a substantially dot-shaped mark therein. The marker system 8 is not described in detail since it is not specifically part of the invention, and its design is well known to the person skilled in the art. In general manner, the marker system 8 enables the marker member 7 to reciprocate along a marking direction X in order to impact the surface S. Conventionally, the marker member 7 is movable between a rest position in which the marker member is retracted relative to the surface S, and a working position in which the marker member is in contact with the surface S.

Insofar as the marker member 7 makes substantially dot-shaped marks and insofar as it is desired in accordance with an object of the invention to mark the surface S with two-dimensional marking M that is made up of a set of dot shapes made by the marker member, the appliance 1 includes a movement device 14 for moving the marker member 7 parallel to two movement planes P and $P_1$ that are mutually perpendicular and perpendicular to the surface S for marking.

The device 14 for moving the marker member 7 is designed to move the marker member 7 over the surface S for marking in a two-dimensional marking window or zone Z. Naturally, the device 14 for moving the marker member 7 may be made by any appropriate means, and in particular in accordance with the description of the device described in patent EP 1 809 488.

The device 14 for moving the marker member 7 is mounted inside the housing 2. In a preferred variant embodiment, the movement device 14 is supported by a carriage 16 mounted to slide relative to the housing 2 in order to enable the position of the marker member 7 to be adjusted relative to the two-dimensional marking zone Z.

In conventional manner, the movement device 14 serves to move the marker member 7 parallel to two movements P, $P_1$ that are mutually perpendicular and perpendicular to the surface S for marking.

In the embodiment shown, the movement device 14 has a path 17 for providing guidance for movement in translation that is implemented in the form of a guide rail fastened on the carriage 16. The movement device 14 also includes movable equipment 18 that co-operates with the guide rail 17 so as to be movable in translation along a direction D parallel to a movement plane P. In order to move the movable equipment 18 in translation along the rail 17 along most travel directions, a motor member 19 is also provided for moving the movable equipment 18 in translation. The motor member 19 has an outlet gear 21 co-operating with a rack 22 that is parallel to the direction D and that forms part of the movable equipment 18. The motor member 19, which is supported by the carriage 16, is connected to a control unit that enables the movement in translation of the movable equipment 18 along the rail 17 to be controlled both ways along the direction D.

In order to enable the marker member 7 to move parallel to the plane $P_1$ that is perpendicular to the plane P, the movement device 17 also includes an oscillating cradle 25 that is fitted on the movable equipment 18 so as to be capable of pivoting relative thereto about an axis D1 parallel to the direction D and thus perpendicular to the plane P1. The marker system 8 is fitted on the cradle 25 in such a manner that the marker pin 7 projects through the front face of the housing.

In order to control pivoting movement of the cradle 25 carrying the marker system 8, the movement device 14 also has a motor member 26 having its outlet gear 27 co-operating with a toothed sector of a C-shaped arm 28 connected to the cradle 25. In the example shown, the motor member 26 is secured to the movable equipment 18 so as to be moved in translation together with the movable equipment 18 along the movement rail 17. The motor member 26 is connected to a control unit for controlling both-way pivoting of the marker member 7 about the axis $D_1$.

By controlling the motor member 19, the above-described movement device 14 serves to move the marker member 7 in translation parallel to the plane P, and by controlling the motor member 26, it serves to pivot the marker member 7 both ways parallel to the plane $P_1$. The above-described combination of movements defines the two-dimensional marking window or zone Z of length that is set by the amplitude of movement in translation along the direction D, and of width that is determined by the amplitude of pivoting movement about the axis D. When the marker system 8 is put into operation, it is thus possible to provide dot marking by means of the marker member 7 at any point situated in the marking window Z as defined above. It is thus possible in this two-dimensional window Z to create marking M that results from marking a set of dots, each of which is obtained by the marker member 7. In the example shown in FIG. 1, the marking M that is obtained reads "SIC MARKING".

Naturally, the movement device 14 as described above is given by way of illustration, such that the movement device 14 could be made in other ways. For example, the movement of the marker member 7 could be provided by a combination of pivoting movements about perpendicular axes. Likewise, the movement device 14 as described above may be fitted with a system for compensating for the effects of the marker member pivoting, e.g. as described in European patent EP 1 809 488.

In accordance with the invention, the appliance 1 also has a nose 30 for positioning the appliance 1 against the surface for marking S. This positioning nose 30 defines the two-dimensional marking zone Z in front of the front face 6 of the housing and at a distance from the front face 6. The positioning nose 30 includes at least one arm 33 (and specifically two arms 33 in the example shown), which are secured to the housing or incorporated in the housing, and which substantially extend the side walls 10 of the housing so as to project from the front face 6. These arms 33 are to be pressed against the surface S for marking, and between their ends that are remote from their ends fastened to the housing, they define the two-dimensional marking zone Z. In the example shown in the drawings, the two-dimensional marking zone Z is defined by an opening provided in a presser plate 34 that is in the form of a frame and that is secured to the ends of the arms 33 remote from their ends secured to the housing. In the example shown, the arms 33 are formed by plates substantially extending the side walls 10, each having one of its ends secured to the housing 2 and having its other end secured to the plate 34. Naturally, this positioning nose 30 could be made in some other way, e.g. by using rods projecting from the housing and having ends that are optionally connected to a bearing plate. Likewise, the arms 33 may also be connected together by a connection member substantially extending the bottom wall 11, such that the positioning nose 30 is in the form of a single one-piece part of channel section.

The positioning nose 30 is also arranged to define an opening 35 in line with the top wall 9 that makes it possible to view the two-dimensional marking zone Z through the top wall 9. In other words, an empty space is left extending the top wall 9 between the front face 6 of the housing and the two-dimensional marking zone Z defined by the plate 34. Insofar as the positioning nose 30 comprises, between the front face 6 and the two-dimensional marking zone Z, no more than the arms 33 that extend substantially parallel to the side walls 10 of the housing, the opening 35 that is provided enables this two-dimensional marking zone to be viewed clearly by an operator U located beside the top wall or above the top wall 9, as shown in FIG. 1.

According to another characteristic of the invention, the top wall 9 of the housing 2 is fitted with at least one display screen 40 mounted so that the screen and the two-dimensional marking zone Z defined by the positioning nose 30 and seen through the opening 35 of the positioning nose can both be seen together in the field of view of an operator above the top wall of the housing. Thus, and as can be seen clearly in FIG. 1, an operator U can see firstly, prior to the marking operation proper, the marking that is going to be made as displayed on the screen 40, together with the two-dimensional marking zone Z, and secondly, during the marking operation, the operator can see simultaneously the marking that is going to be made as displayed on the screen 40 together with the marking that is being made in the two-dimensional marking zone Z.

According to a preferred embodiment characteristic, the display screen 40 is mounted on the top wall 9 so as to be situated as close as possible to the front face 6 of the housing 2. Advantageously, the top wall 9 presents a profile $\mathbf{9}_2$ that is curved towards the inside of the housing, which profile $\mathbf{9}_2$ extends from the display screen 40 to an end edge $\mathbf{9}_1$ defining a portion of the front face 6 of the housing. The curved profile of the top wall 9 that is situated between the display screen 40 and the front face 6 enhances viewing of the two-dimensional marking zone Z through the opening 35 defined between the front face and the two-dimensional marking zone Z.

In a preferred embodiment, the two-dimensional marking zone Z defined by the positioning nose 30 is situated at a distance d from the edge $\mathbf{9}_1$ of the front end of the top wall 9 that lies in the range 50 mm to 80 mm, whereas the front edge of the display screen 40, i.e. the edge of the screen that is closest to the front face, is situated at a distance $d_1$ from the two-dimensional marking zone Z that lies in the range 70 mm to 120 mm.

In a preferred embodiment variant, the top wall 9 has a man-machine interface 45 advantageously including the display screen 40. As mentioned above, the display screen 40 is positioned as close as possible to the edge $\mathbf{9}_2$ of the front end of the top wall 9. The man-machine interface 45 may be constituted by any appropriate means for example such as a touch screen or a keypad, so as to enable the operator to input all of the commands needed for operating the appliance. It should be understood that the top wall 9 incorporates this man-machine interface 45 with the display screen 40. In a preferred embodiment variant, the top wall 9 has a cavity or housing 47 for positioning the man-machine interface 45 and the display screen 40. This man-machine unit 45 is connected to a unit for controlling the operation of the display screen, of the marker system 8, and of the device 14 for moving the marker member.

A marking operation is started by a control switch 48, e.g. placed on the handle. According to a characteristic of the invention, this control unit controls the display screen 40 so as to display on the screen the marking that is going to be made, both prior to executing the marking operation, and also while performing the marking operation. The marking M to be made is preferably displayed on the screen 40 full size, i.e. to scale.

It can be seen from the above description that the portable appliance 1 of the invention does not have fragile electronic components on its rear face 5. Specifically, all of the electronics components are advantageously grouped together on an electronic card situated at the top wall 9 of the housing. Thus, the rear face 5 of the housing can be used by the operator to exert a thrust force so as to place the positioning nose 30 pressing correctly against the surface S, given that this rear face 5, as explained above, is rigidly connected to the positioning nose 30 by the body of the housing 2.

According to another characteristic of the invention, the handle 3 is provided, at its end remote from the end connected to the housing, with a plane support wall 50 enabling the appliance to be put into an upstanding position. Such an arrangement makes it easier to perform input operations on the man-machine interface 45 of the housing insofar as the top wall extends, when in this upstanding position, in a plane that is substantially horizontal or that slopes up to an angle of less than about 20°. Furthermore, it should be observed that the operator can input commands via this man-machine interface 45 by using both thumbs while holding the appliance in both hands, whether or not it is in its upstanding position.

According to an embodiment characteristic that is shown, the support wall 50 forms part of an electrical power supply battery block 52 for the appliance, which block is mounted at the end of the handle 3 remote from its end that is fastened to the housing. Advantageously, the handle 3 is provided at its end remote from its end connected to the housing with a support 53 for interchangeably connecting an electrical power supply battery to the appliance. Naturally, the appliance of the invention need not have batteries and it could be provided via the connection support 53 with a chord for connecting to an electrical power supply.

Figure 5:
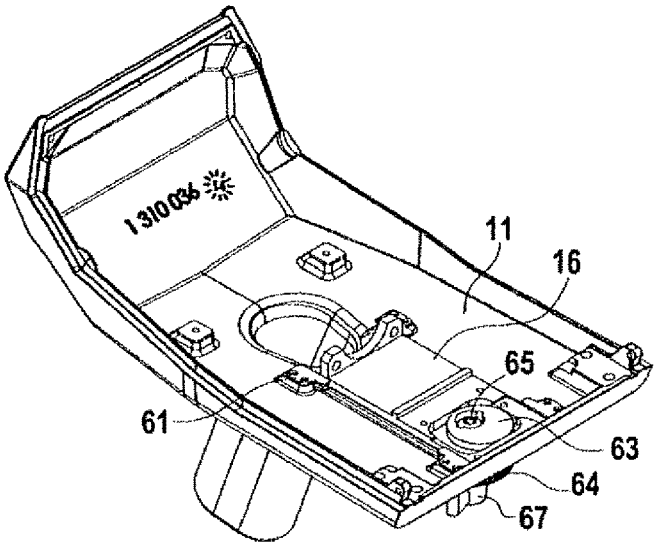
FIG. 5 is a detail view characteristic of the portable marker appliance in accordance with the invention showing how the device for moving the mounting member is slidably mounted.
Figure 6:
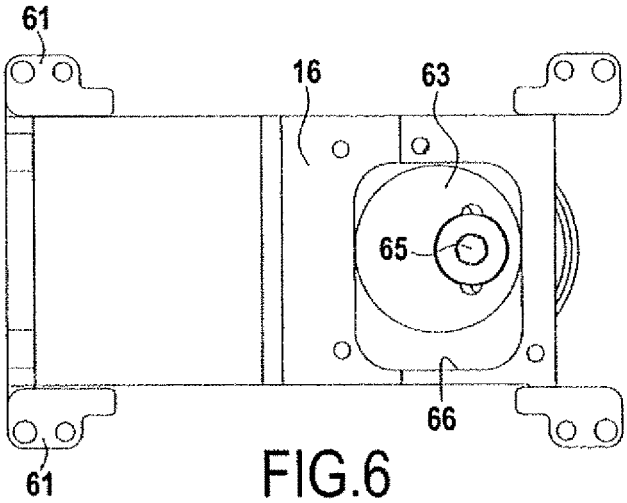
FIG. 6 is a plan view of the carriage supporting the device for moving the marker member, placed in the retracted position.
Figure 7:
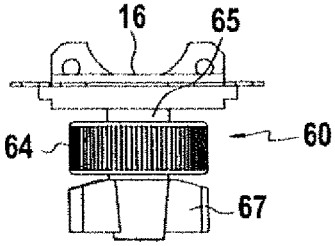
FIG. 7 is an elevation view showing a detail of the control for the carriage supporting the device for moving the marker member.

As explained above, the device 14 for moving the marker member 7 is mounted on a carriage 16 that makes it possible, at will, to set the position of the marker member 7 relative to the two-dimensional marking zone Z. For this purpose, the carriage 16 is provided with a manual mechanism 60 for moving and locking the carriage relative to the housing 2. As can be seen more precisely in FIGS. 5 to 7, the carriage 16 is slidably mounted on guides 61 arranged on the inside face of the bottom wall 11 of the housing. The carriage 16 is moved in translation by the mechanism 60 so as to move the marker member 7 away from or towards the two-dimensional marking zone Z. In the example shown, the mechanism 60 comprises a cam or eccentric 63 that is turned by a knob 64 securely mounted to a rotary shaft 65 itself secured to the eccentric. Manually turning the knob 64 serves to turn the eccentric inside a cavity 66 provided in the carriage 16. Turning the eccentric thus leads to the carriage 16 being moved in translation. The knob 64 for turning the eccentric is locked in position by a locking lever 67 that serves to lock the position of the control knob. Mounting the entire movement device 14 on the carriage 16 provides the advantage of being able to adjust the initial position of the marker member 7 relative to the surface for marking M, in particular as a function of the hardness of the material constituting the surface for marking.

It should be observed that this adjustment system enables the operator to adjust directly the distance in the marking position between the marker member 7 and the surface for marking S. The operator's rear hand presses the positioning nose 30 against the surface for marking S, while the operator looks through the opening 35 to see the distance between the marker member 7 and the surface for marking S. Simultaneously, the operator's hand underneath can turn the eccentric 63 in order to adjust the position of the carriage 16 and then lock that position.

The invention is not limited to the examples described and shown since various modifications can be made thereto without going beyond the ambit of the invention.

The invention claimed is:

1. A portable appliance for marking a surface (S), the appliance comprising:

a housing (2) provided with at least one handle (3) and presenting remote from a rear face (5) an open front face (6) for passing a marker member (7) that forms part of a marker system (8) and that is adapted to make at least one substantially dot-shaped mark, the front and rear faces (6, 5) being connected together at least by a top wall (9) and by two opposite side walls (10), at least one of the faces of the housing being provided with a display screen (40); and a movement device (14) for moving the marker member (7) that is mounted inside the housing and that is adapted to move the marker member (7) over the surface for marking (S) in a two-dimensional marking zone (Z);

the appliance being characterized in that the housing (2) is provided with a positioning nose (30) for positioning the appliance against the surface for marking (S), the positioning nose (30) defining firstly the two-dimensional marking zone (Z) in register with the front face (6) of the housing and at a distance from the front face, and secondly an opening (35) in line with the top wall (9) for viewing the two-dimensional marking zone (Z), and in that the top wall (9) of the housing is fitted with the display screen (40) in such a manner that the screen (40) and the two-dimensional marking zone (Z) as seen through the opening (35) of the positioning nose appear simultaneously in the field of view of an operator above the top wall (9) of the housing.

2. A portable marker appliance according to claim 1, characterized in that the top wall (9) presents a profile ($9_2$) that is curved towards the inside of the housing, extending from the display screen (40) and as far as the front end edge ($9_1$) defining a portion of the front face of the housing.

3. A portable marker appliance according to claim 1, characterized in that the two-dimensional marking zone (Z) defined by the positioning nose (30) is situated at a distance (d) from the front end edge ($9_1$) of the top wall (9), which distance lies in the range 50 mm to 80 mm, while the front edge of the display screen (40) is situated at a distance ($d_1$) from the two-dimensional marking zone (Z) that lies in the range 70 mm to 120 mm.

4. A portable marker appliance according to claim 1, characterized in that the top wall (9) includes a man-machine interface (45) with the display screen (40) situated as close as possible to the front end edge ($9_1$) of the top panel (9).

5. A portable marker appliance according to claim 1, characterized in that the positioning nose (30) includes at least two arms (33) extending substantially from the side walls (10) of the housing and connected together by an open bearing plate (34) for defining the two-dimensional marking zone (Z).

6. A portable marker appliance according to claim 1, characterized in that the housing (2) includes at a rear face (5) thereof a rear thrust wall for the operator, which rear thrust wall is rigidly connected to the positioning nose (30).

7. A portable marker appliance according to claim 1, characterized in that it includes a unit for controlling the operation of the display screen (40) and of the device (14) for moving the marker member (7) in such a manner as to display on the screen the marking that is to be made prior to and simultaneously with controlling the marker member.

8. A portable marker appliance according to claim 1, characterized in that the housing (2) includes a handle (3) extending from a bottom wall (11) situated in register with the top wall (9).

9. A portable marker appliance according to claim 8, characterized in that, at an end of the handle remote from an end of the handle connected to the housing, the handle (3) is fitted with a support (53) for interchangeably connecting an electrical power supply battery of the appliance.

10. A portable marker appliance according to claim 9, characterized in that the power supply battery has a plane face (50) for supporting the appliance in an upstanding position.

11. A portable marker appliance according to claim 1, characterized in that the device (14) for moving the marker member (7) is mounted on a carriage (16) that is slidably mounted for adjusting the position of the marker member (7) relative to the two-dimensional marking zone (Z), a mechanism (60) for moving and locking the carriage relative to the housing being provided with a manual control.

12. A portable marker appliance to claim 11, characterized in that the mechanism (60) for moving the carriage (16) includes an eccentric (63) that is turned by a knob (64) and that serves to move the carriage (16) in translation, the carriage being guided to move in translation relative to the housing, the control knob (64) of the eccentric being locked in position by a locking lever (67).

* * * * *